US009877557B2

(12) United States Patent
Collins et al.

(10) Patent No.: US 9,877,557 B2
(45) Date of Patent: Jan. 30, 2018

(54) UPRIGHT GARMENT BAG WITH AN INTERIOR AND EXTERIOR HANGING SYSTEM

(71) Applicant: Grit, Inc., Tottenham (CA)

(72) Inventors: Gregory James Collins, Loretto (CA); Erin Dawn Dobo, Barrie (CA); Matthew Gordon Thomas Hughson, Vaughan (CA)

(73) Assignee: Grit Inc., Tottenham (CA)

( * ) Notice: Subject to any disclaimer, the term of this patent is extended or adjusted under 35 U.S.C. 154(b) by 0 days.

(21) Appl. No.: 14/947,229

(22) Filed: Nov. 20, 2015

(65) Prior Publication Data

US 2016/0143406 A1 May 26, 2016

(30) Foreign Application Priority Data

Nov. 20, 2014 (CA) ..... 2871810

(51) Int. Cl.

| | |
|---|---|
| ***A45C 5/14*** | (2006.01) |
| ***A47G 29/00*** | (2006.01) |
| ***A45C 13/03*** | (2006.01) |
| ***A45C 15/00*** | (2006.01) |
| *E04H 15/32* | (2006.01) |

(52) U.S. Cl.

CPC ..... *A45C 13/03* (2013.01); *A45C 5/14* (2013.01); *A45C 15/00* (2013.01); *A45C 2200/15* (2013.01); *E04H 2015/326* (2013.01)

(58) Field of Classification Search

CPC ..... A45C 13/03; A45C 2200/15; A45C 5/14; A45C 7/0036; A45C 13/26; A45C 13/28; A47G 25/0685; A47G 25/0664; A47B 61/06; B65D 85/62; E04B 1/18; E04H 2015/326; E04H 15/44; B65B 69/0008

USPC ..... 206/286, 289, 279, 290; 211/85.3, 195; 190/13 R, 14, 15 A, 15 R, 16, 18 A, 102; 135/123

See application file for complete search history.

(56) References Cited

U.S. PATENT DOCUMENTS

| | | | | | |
|---|---|---|---|---|---|
| 930,343 | A * | 8/1909 | Bonsall | A45C 13/03 190/14 |
| 1,340,565 | A * | 5/1920 | Seidenburg | A47B 61/06 211/1.3 |
| 1,520,044 | A * | 12/1924 | Wilt | A45C 5/04 190/13 R |

(Continued)

*Primary Examiner* — J. Gregory Pickett
*Assistant Examiner* — Gideon Weinerth
(74) *Attorney, Agent, or Firm* — Frost Brown Todd LLC

(57) ABSTRACT

The garment bag of the present invention offers two means of hanging garments, both on the interior and on the exterior of the bag. The interior hangers are used when packing, storing, and transporting the user's garments. The exterior collapsible and removable rack is employed when the bag is used at an event/competition. This hanging system is an improvement over existing dance bags in two distinct ways: the upright bag design with the interior hangers allows the user to effectively fit, store, and organize their garments while existing bags lack the interior storage and hanging system; and the present bag provides a collapsible and removable rack that is easily set up and inserted into the bag's exterior holders for holding the garments external to the bag when at an event/competition. Existing dance bags with similar racks require a more difficult assembly and the bag must lie horizontal rather than upright.

9 Claims, 13 Drawing Sheets

(56) References Cited

U.S. PATENT DOCUMENTS 1,615,265 A * 1/1927 Fleischman ..... A47B 61/06 190/13 B
1,889,582 A * 11/1932 Wilt ..... A45C 13/03 206/289
2,476,932 A * 7/1949 Tucker ..... A45C 13/03 190/15 R
2,639,793 A * 5/1953 Hellman ..... G09F 5/02 190/13 R
2,647,594 A * 8/1953 Lutzelschwab ..... A45C 5/14 190/2
3,141,535 A * 7/1964 Hamilton ..... A45C 13/03 190/13 R
4,267,905 A * 5/1981 Stewart ..... A45C 13/02 190/13 R
4,982,820 A * 1/1991 Scott ..... A45C 9/00 190/13 R
4,998,603 A * 3/1991 Nordstrom ..... A45C 3/004 190/108
5,117,951 A * 6/1992 Sisson ..... A45C 13/03 190/13 C
5,167,306 A * 12/1992 Carrigan, Jr. ..... A45C 13/262 190/115
5,706,921 A * 1/1998 Wang ..... A45C 13/262 16/403
6,264,047 B1 * 7/2001 Crumley ..... A47G 25/0685 190/102
6,595,354 B1 * 7/2003 Scicluna ..... A45C 13/03 206/279
6,679,644 B1 * 1/2004 Heller ..... A63H 33/10 135/127
6,748,962 B2 * 6/2004 Miller ..... E04B 1/3211 135/120.3
7,384,097 B2 * 6/2008 Park ..... A47C 4/286 297/16.1
7,537,187 B2 * 5/2009 Park ..... A47C 17/70 248/200
7,607,535 B2 * 10/2009 Jackson ..... A45C 9/00 190/112
7,900,646 B2 * 3/2011 Miller ..... E04H 15/44 135/120.3
7,901,018 B2 * 3/2011 Baughman ..... A47B 43/00 190/11
8,453,812 B2 * 6/2013 Xiao ..... A45C 7/0063 190/1
9,622,597 B2 * 4/2017 White ..... A47F 7/24
2007/0068758 A1 * 3/2007 Nagata ..... A45C 13/262 190/115
2007/0256994 A1 * 11/2007 Jackson ..... A45C 9/00 211/85.3
2009/0321204 A1 * 12/2009 Barkow ..... A45C 13/02 190/8
2012/0006638 A1 * 1/2012 Semersky ..... A45C 13/262 190/115
2012/0055750 A1 * 3/2012 Xiao ..... A45C 7/0063 190/18 A
2012/0125728 A1 * 5/2012 Tamarkin ..... A45C 5/04 190/13 R
2013/0264160 A1 * 10/2013 Mediamolle ..... A45C 13/28 190/102
2014/0027225 A1 * 1/2014 Richards ..... A45C 7/0031 190/13 R
2014/0027227 A1 * 1/2014 Stern ..... A45C 13/262 190/18 A
2014/0060989 A1 * 3/2014 Johnson ..... A45C 13/001 190/102
2014/0202897 A1 * 7/2014 Collins ..... A45C 3/001 206/315.1
2014/0262659 A1 * 9/2014 Hirsch ..... A47B 61/06 190/13 R
2016/0113388 A1 * 4/2016 Distefano ..... A47B 5/04 108/41
2016/0143406 A1 * 5/2016 Collins ..... A45C 5/14 53/410
2016/0219997 A1 * 8/2016 Collins ..... A45C 5/14
2017/0071302 A1 * 3/2017 McKelvey ..... A45C 9/00

* cited by examiner

UPRIGHT GARMENT BAG WITH AN INTERIOR AND EXTERIOR HANGING SYSTEM

RELATED APPLICATION

The Present application claims priority to Canadian Patent Application Serial No. 2,871,810 filed Nov. 20, 2014, the disclosure of which is hereby incorporated herein by reference in its entirety.

FIELD OF THE INVENTION

This invention relates to a hanging system that is incorporated into a rigid or semi-rigid upright bag design. More particularly this invention relates to a garment hanging system targeted but not limited to the dance industry, allowing the user to hang their garments on the interior of the bag during transportation, as well as on the exterior of the bag when in use and/or at a competition. Additional uses for the exterior rack could include the hanging of other textiles, sports equipment, towels and accessories as examples.

BACKGROUND OF THE INVENTION

Within the dance industry there exists a variety of dance types, styles, and genres. Dancers typically bring a variety of outfits and accessories when participating in a competition. There are two main concerns surrounding these garments for the competitions: the first concern being the proper transportation of the garments from home to the site of competition; and the second being the ease of accessibility to the garments when at the competition as dancers must change and prepare for a number of dances in a short period of time. Conventional dance bags are typically too small to fit the length of the garments properly and/or fail to offer an easy, flexible and collapsible framework for hanging garments within the bag and externally. FIGS. 1A-1D provide several images of such prior art bags. There is therefore the need for bag that overcomes these deficiencies, and that can be used in the dance, sports or other garment industries.

SUMMARY OF THE INVENTION

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter. The present invention seeks to offer a means of hanging garments (or textiles, sports equipment, towels, accessories and the like) to the interior and exterior of an upright bag. GRIT Inc.'s hanging system includes at least two interior hangers that effectively hang-up and transport garments, keeping them clean and organized when transporting the bag to an event or competition. Once at the competition the user is able to employ a collapsible and removable exterior rack to the upright bag to hold the garments, thereby allowing the user to visually see each garment as well as change outfits without difficulty. As stated above, additional uses for the exterior rack could include the hanging of other textiles, sports equipment, towels and accessories as examples.

DETAILED DESCRIPTION OF THE INVENTION

A detailed description of the illustrative embodiments and possible implementations of the present invention will now be provided. Various modifications and variations of the described systems and methods of the invention will be apparent to those skilled in the art without departing from the scope and spirit of the invention. As well, alternative uses may be made of the present invention without departing from its scope. Furthermore, certain terms have been used for brevity, clarity, and understanding. No unnecessary limitations are to be implied therefrom because such terms are used for descriptive purposes and are intended to be broadly construed.

Figure 1A:
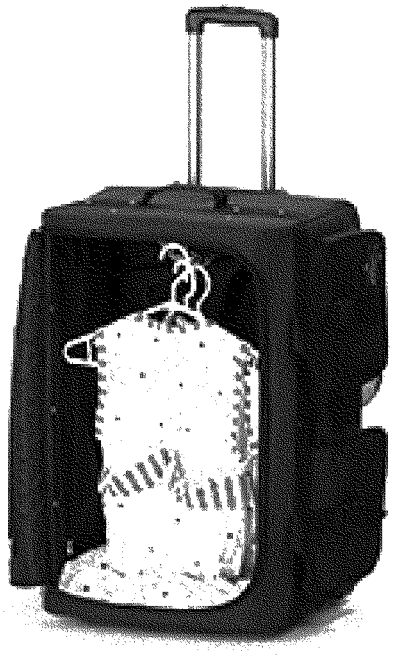
FIG. 1A PRIOR ART
FIGS. 1A-1D shows existing dance competition bags.
Figure 1B:
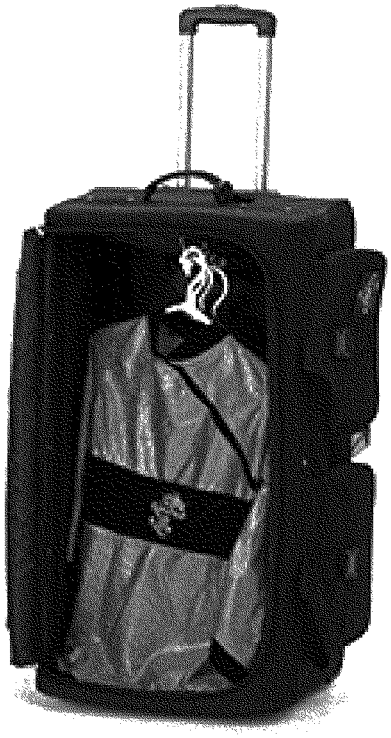
FIG. 1B PRIOR ART
Figure 1C:
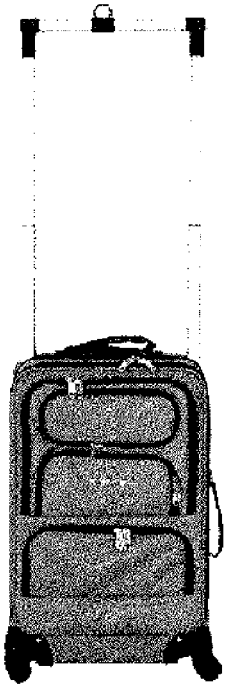
FIG. 1C PRIOR ART
Figure 1D:
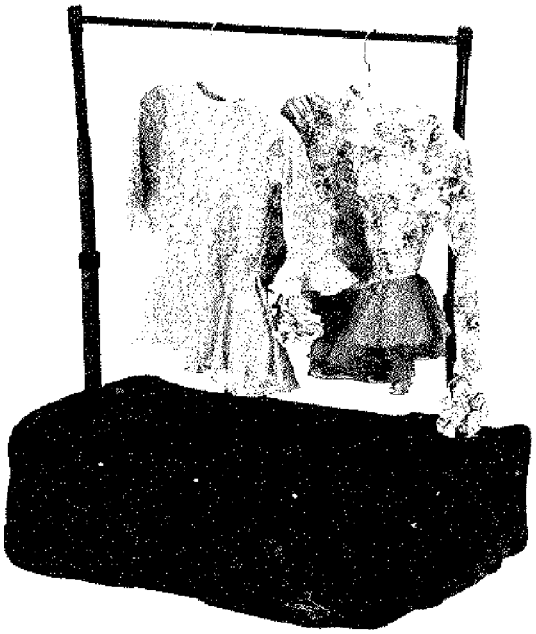
FIG. 1D PRIOR ART
Figure 2:
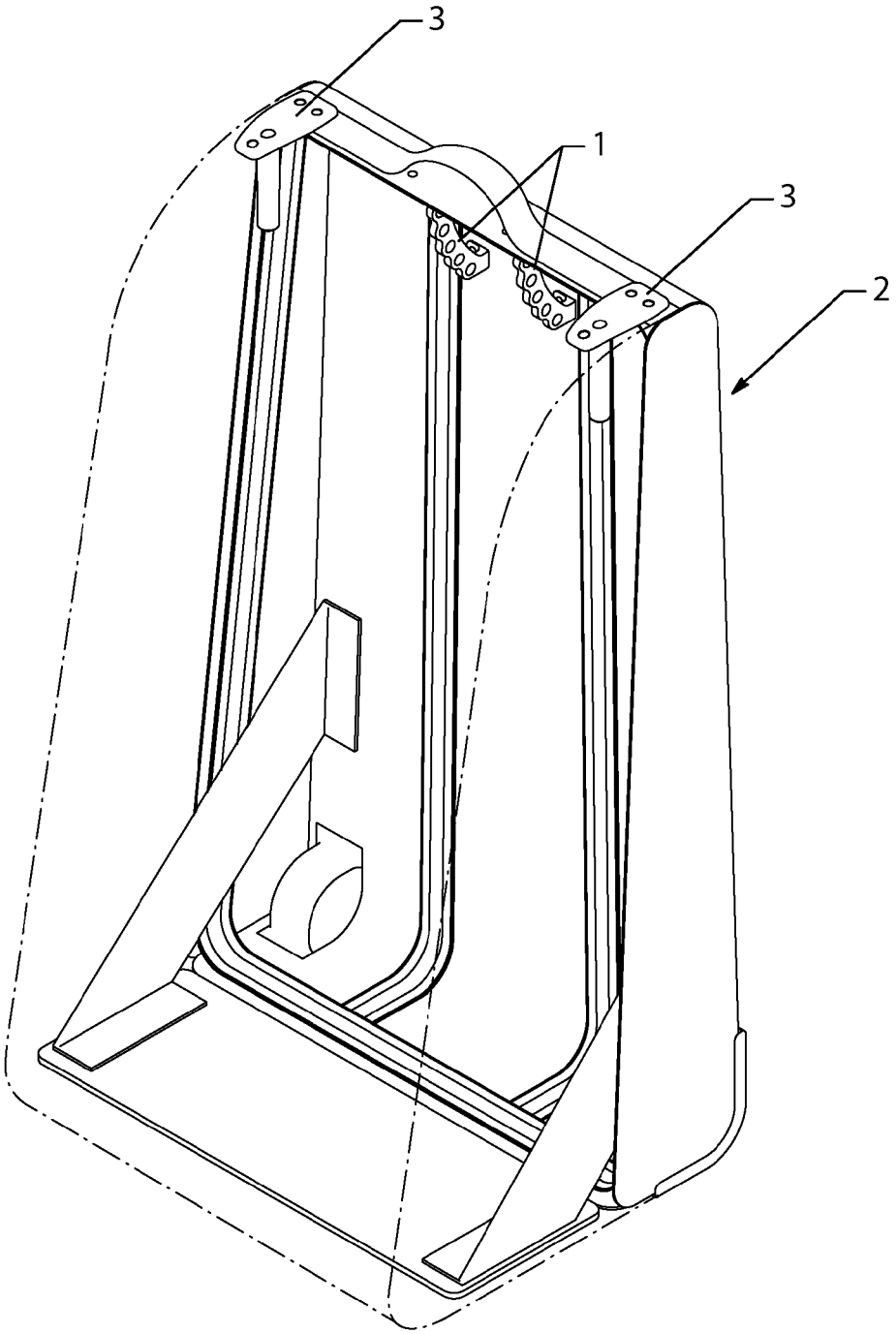
FIG. 2 is a perspective view of an embodiment of the garment bag of the present invention with the exterior rack removed.
Figure 3A:
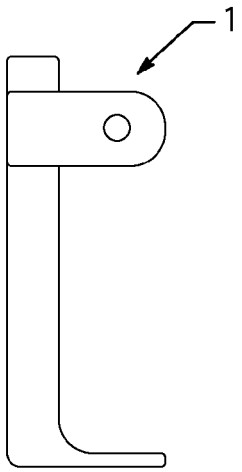
FIGS. 3A-3D show various views of a preferred embodiment of a hanger of the present invention.
Figure 3B:
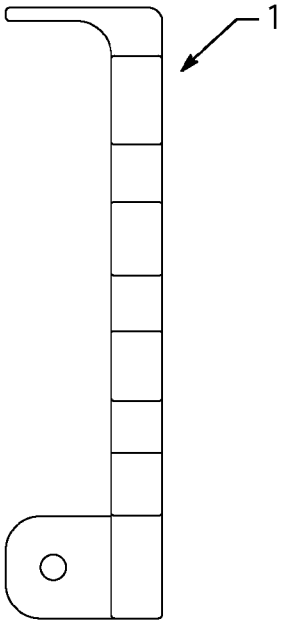
Figure 3C:
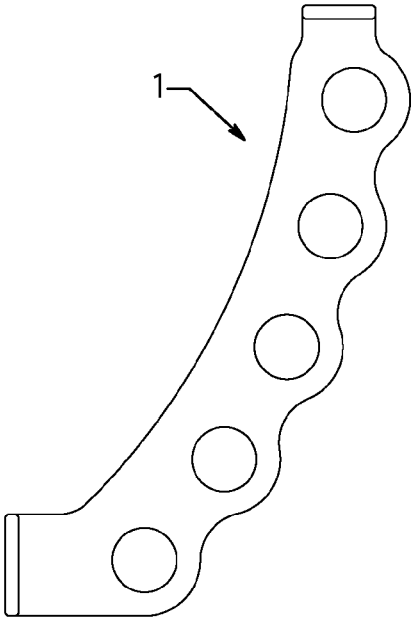
Figure 3D:
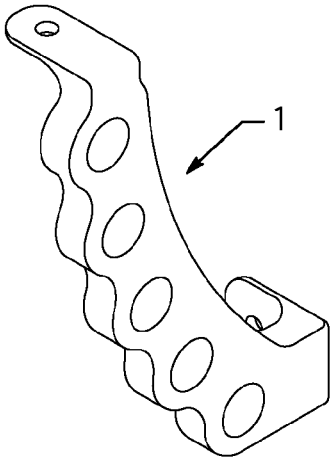
Figure 4:
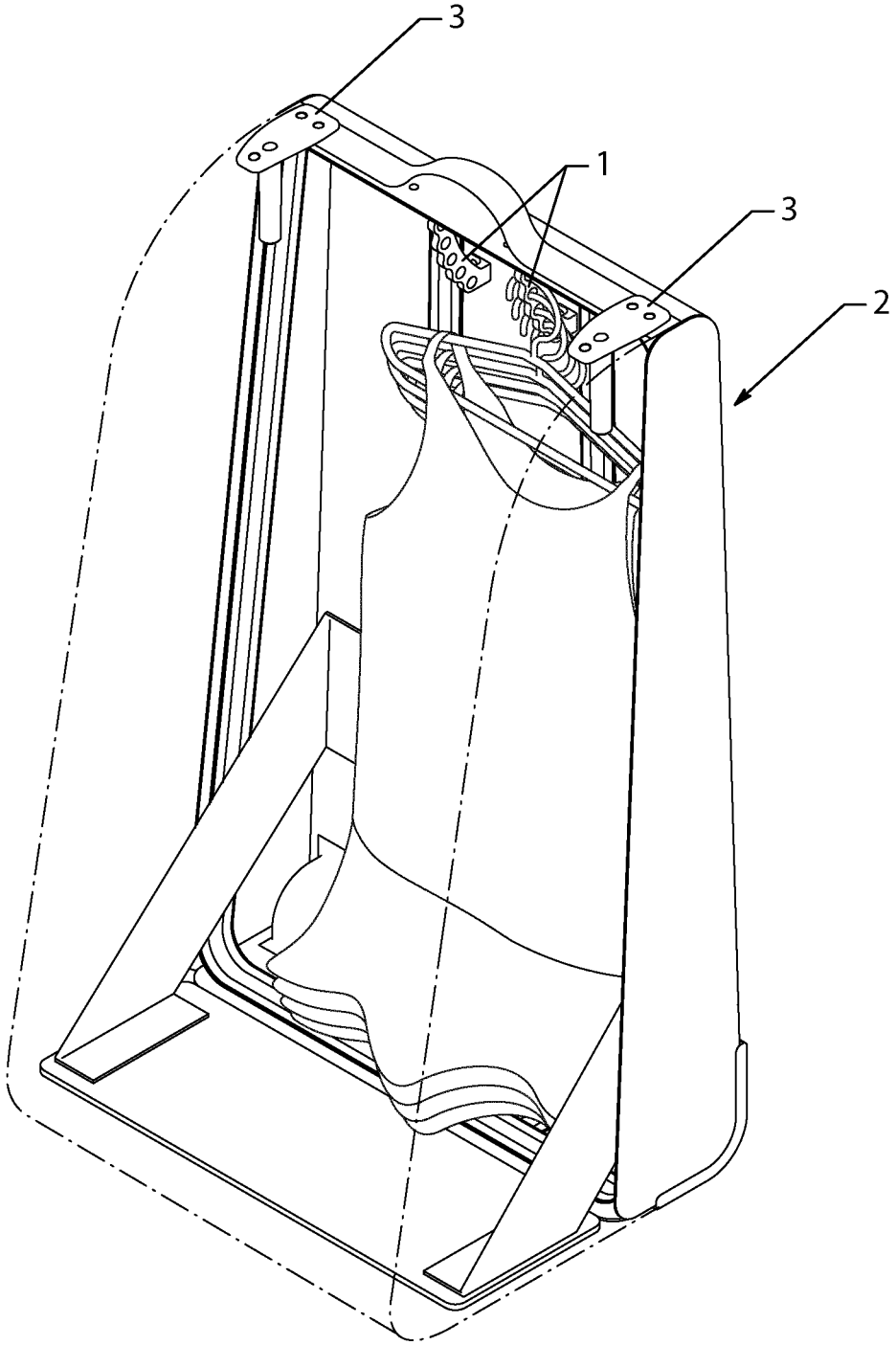
FIG. 4 is a perspective view showing the function of the interior hangers.
Figure 5A:
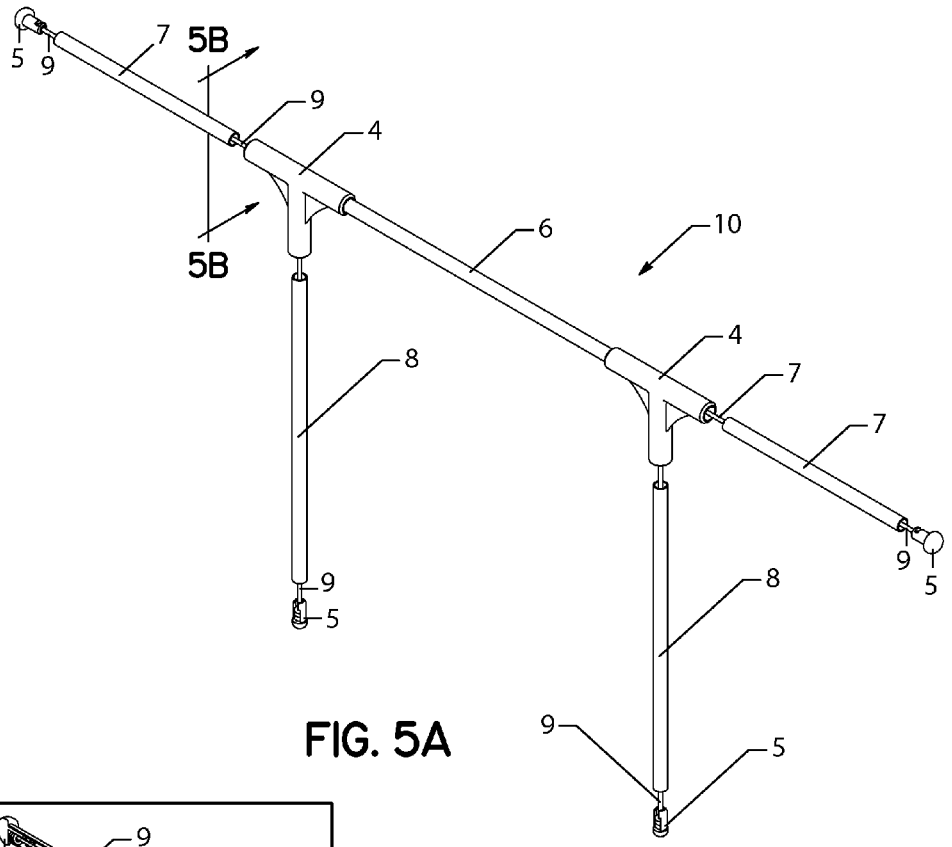
FIG. 5A is a perspective view of the exterior rack expanded showing the bungee cord connections and how the rack is assembled.
Figure 5B:
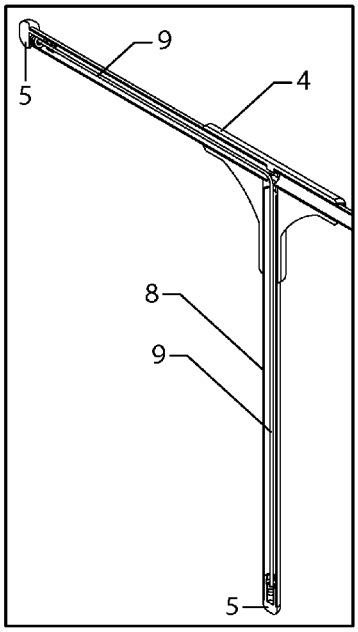
FIG. 5B is a perspective cut-out section view of the exterior rack in an assembled position.
Figure 5C:
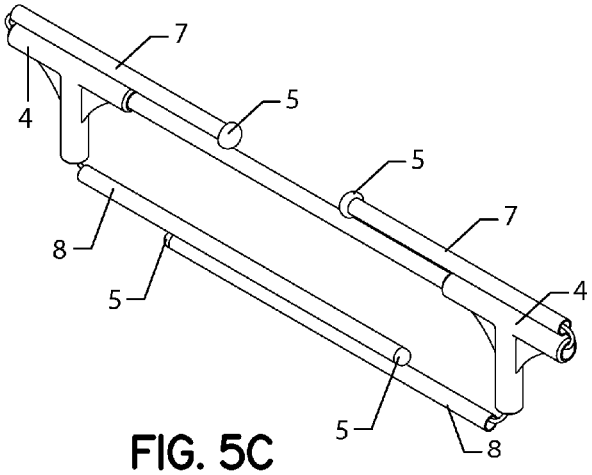
FIG. 5C is a perspective view of the exterior rack in a collapsed position.
Figure 6:
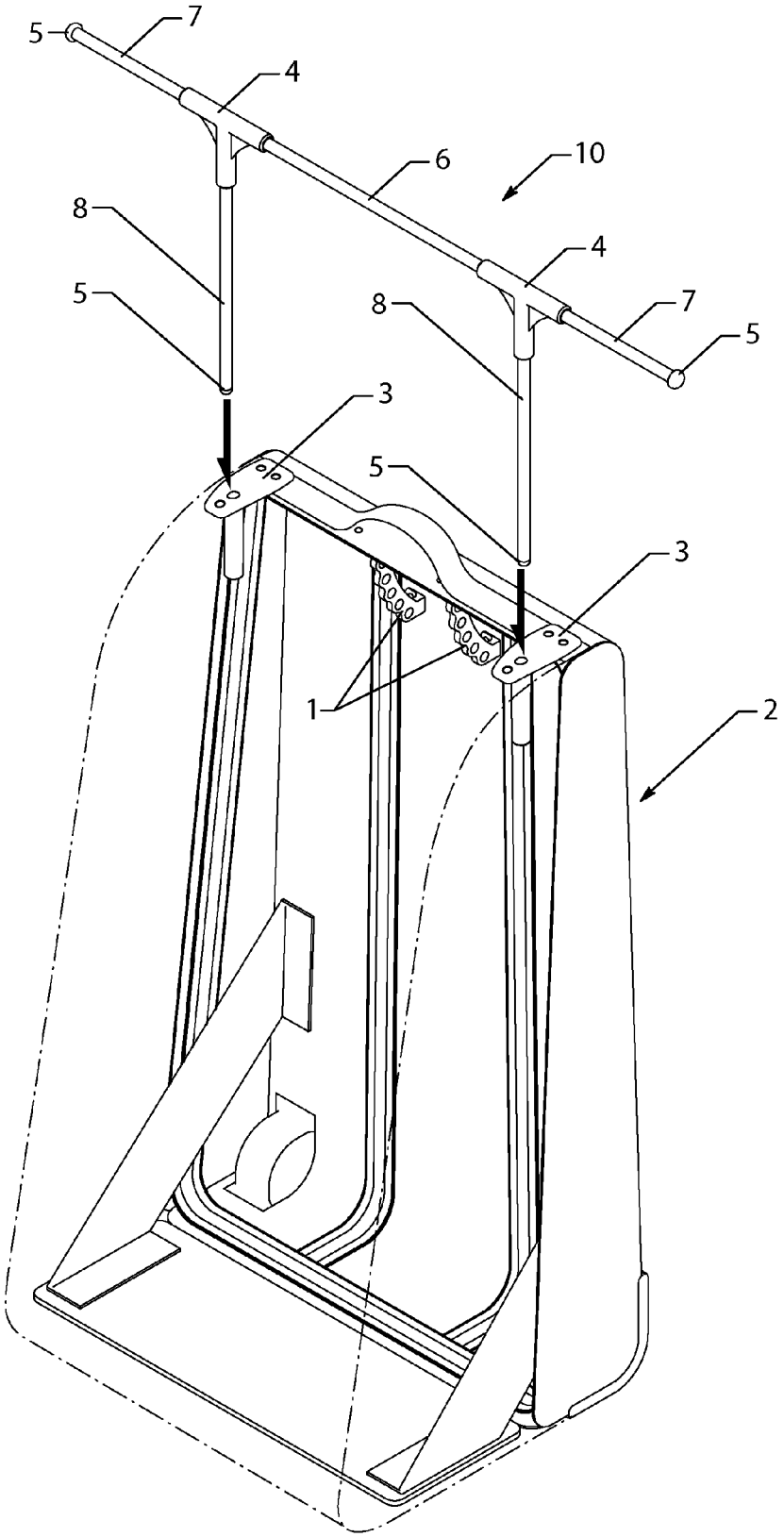
FIG. 6 is a perspective view of an embodiment of the garment bag of the present invention with the exterior rack being inserted.
Figure 7:
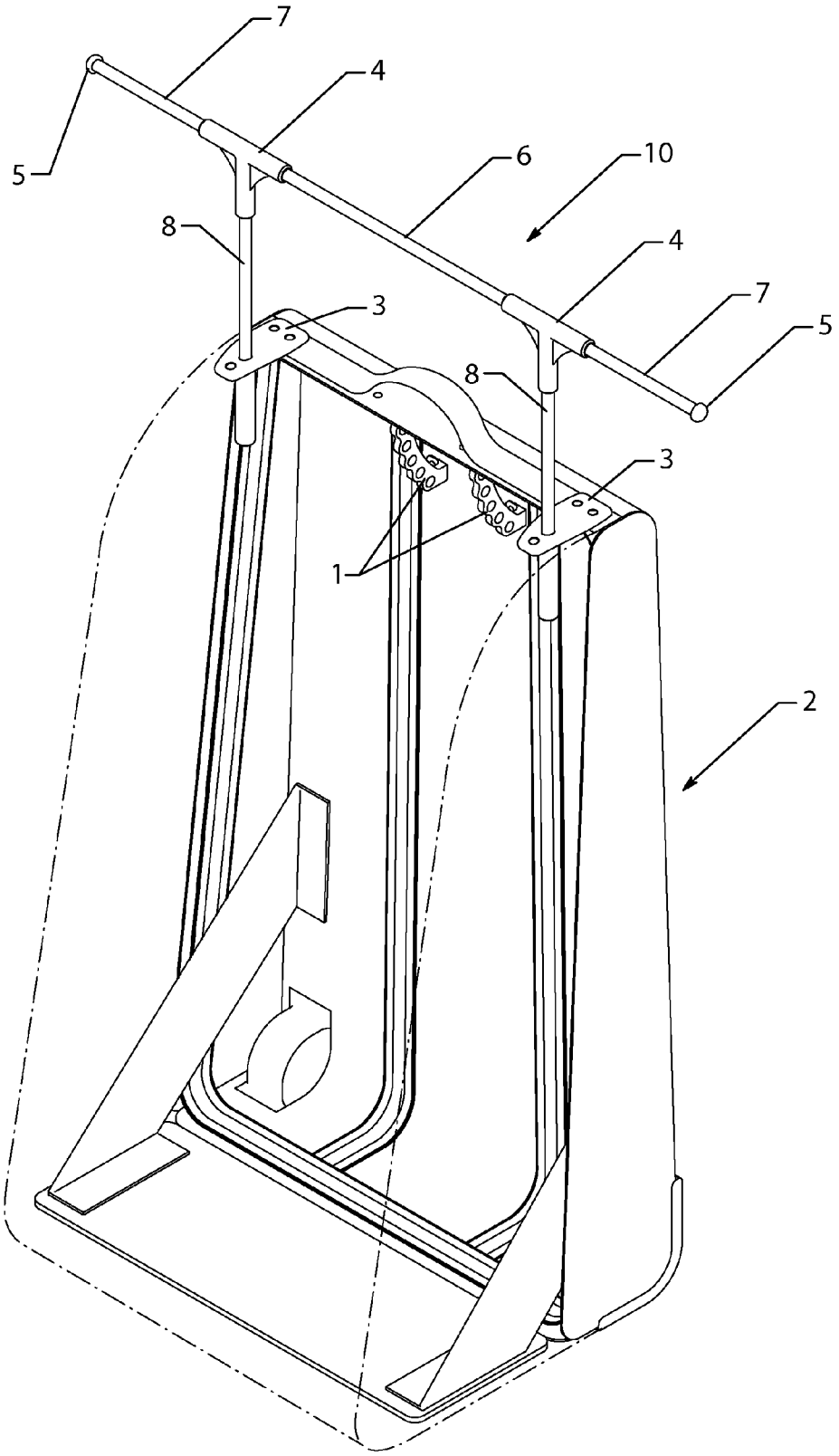
FIG. 7 is a perspective view of an embodiment of the garment bag of the present invention with the exterior rack inserted.
Figure 8:
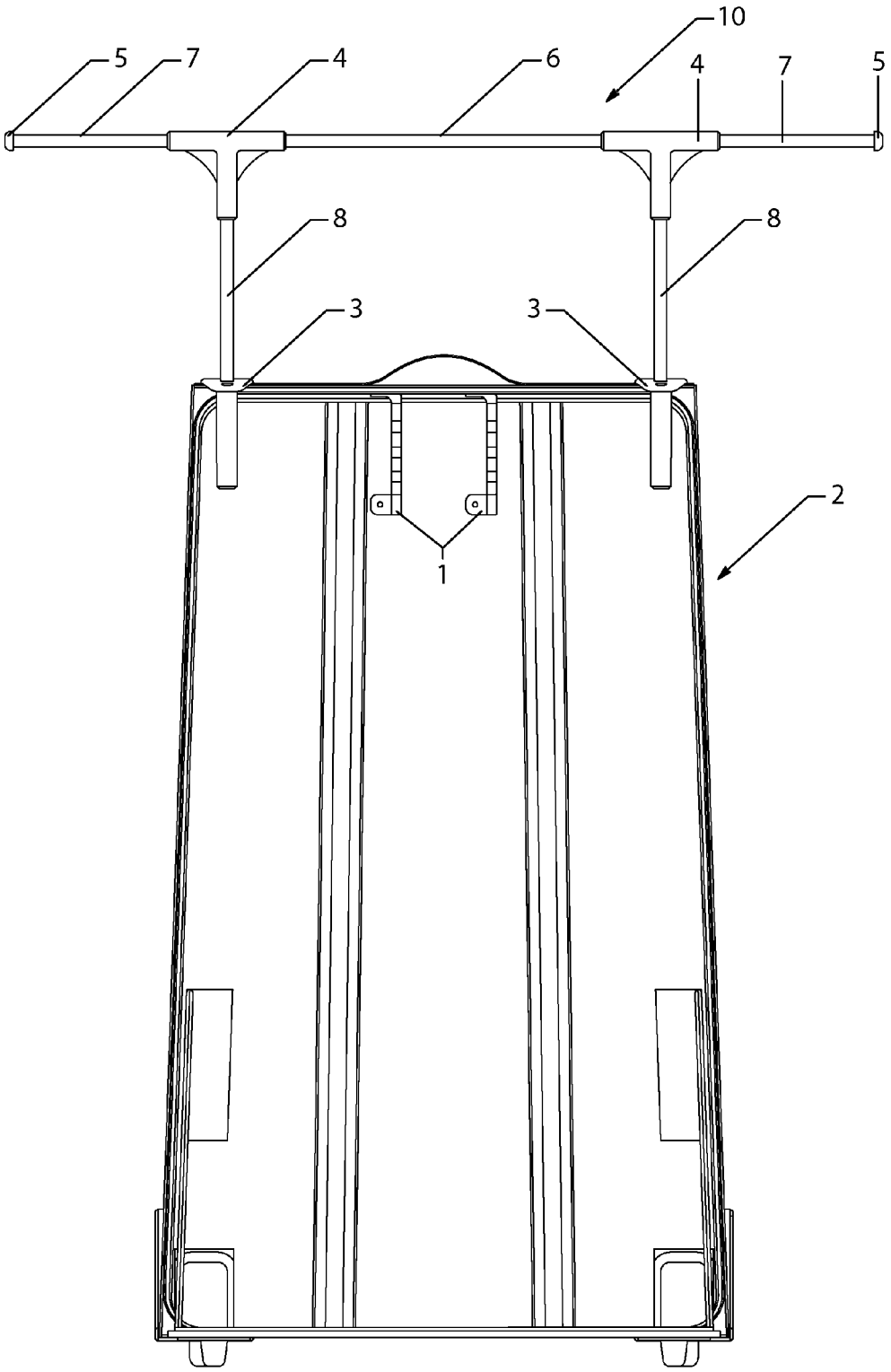
FIG. 8 is a front elevation view of an embodiment of the garment bag of the present invention with the exterior rack inserted.
Figure 9:
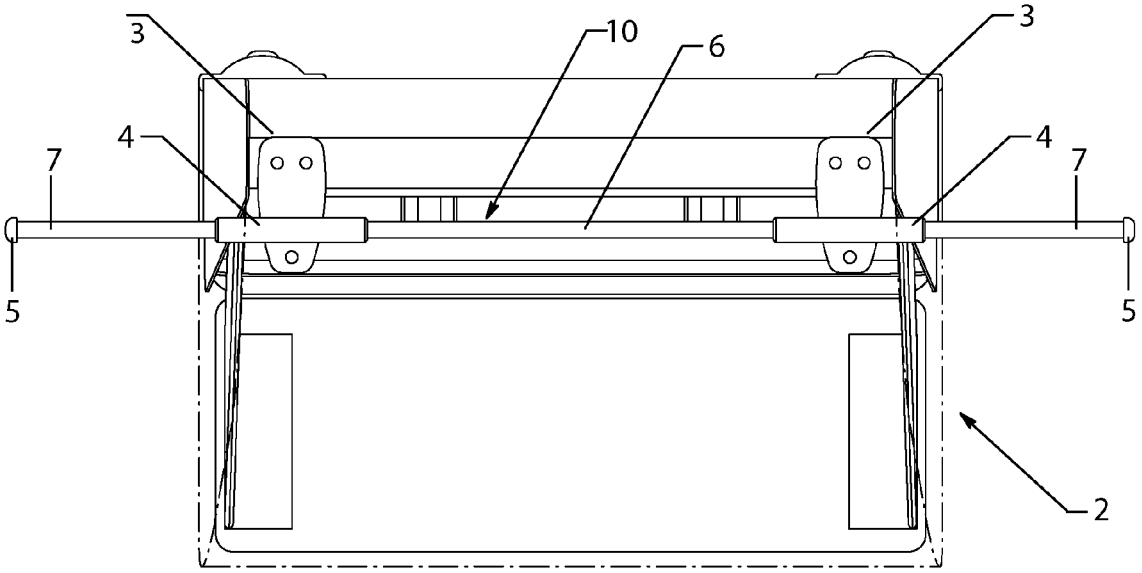
FIG. 9 is a top view of an embodiment of the garment bag of the present invention with the exterior rack inserted.
Figure 10:
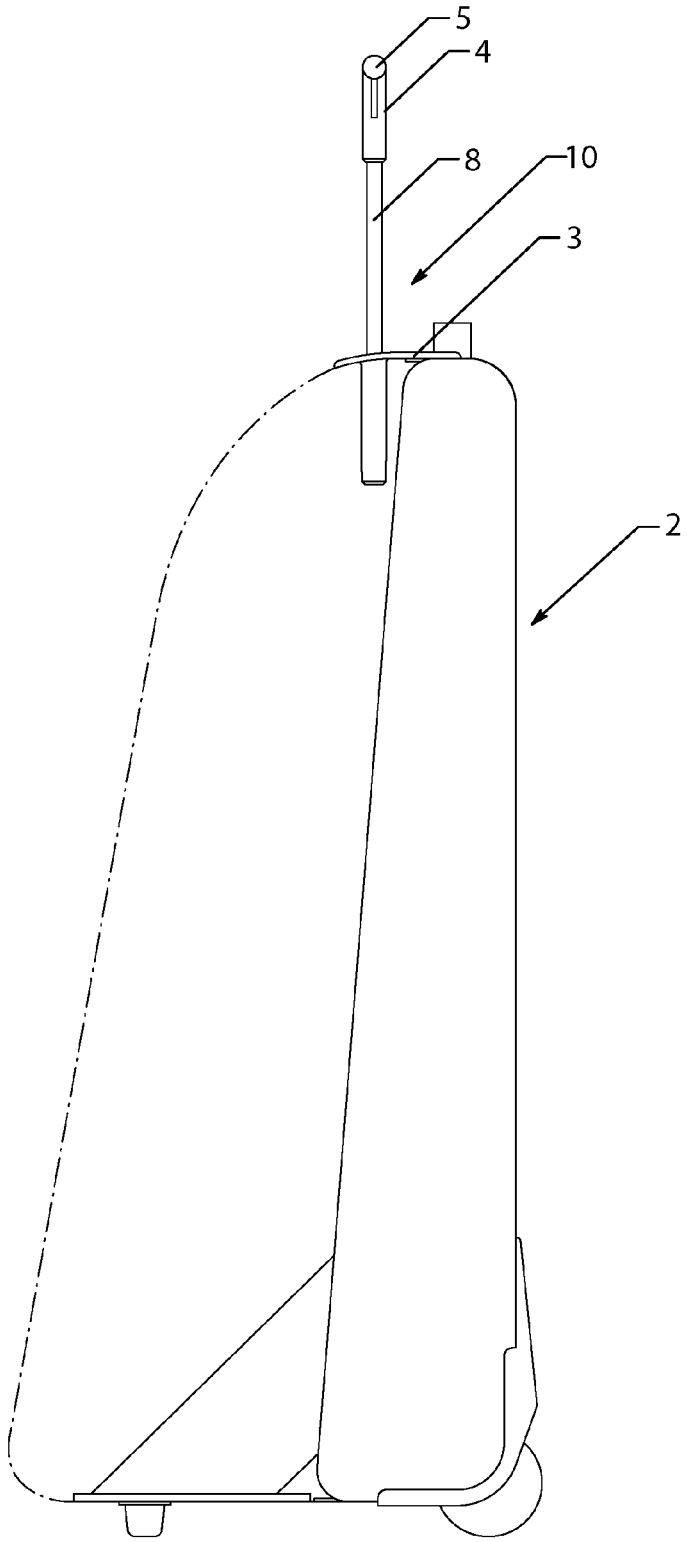
FIG. 10 is a right side elevation view of an embodiment of the garment bag of the present invention with the exterior rack inserted.
Figure 11:
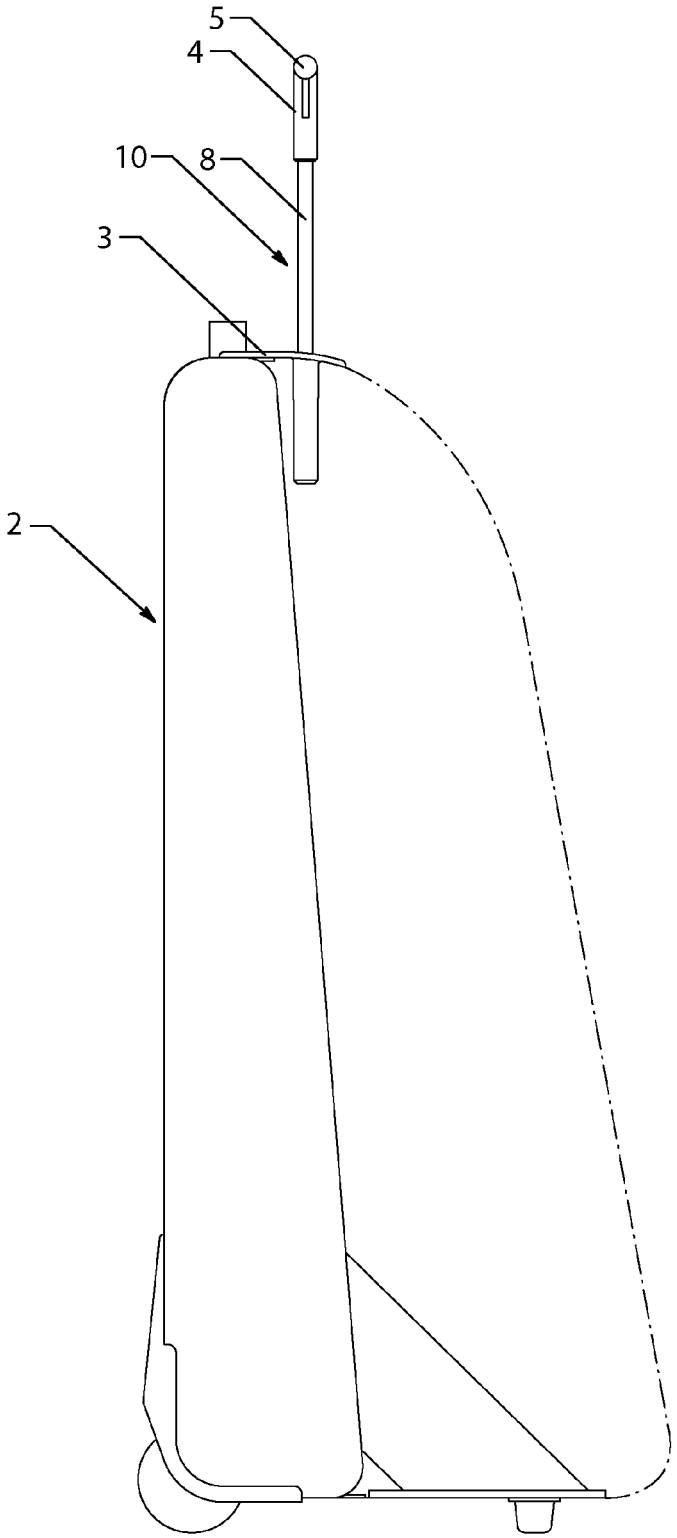
FIG. 11 is a left side elevation view of an embodiment of the garment bag of the present invention with the exterior rack inserted.
Figure 12:
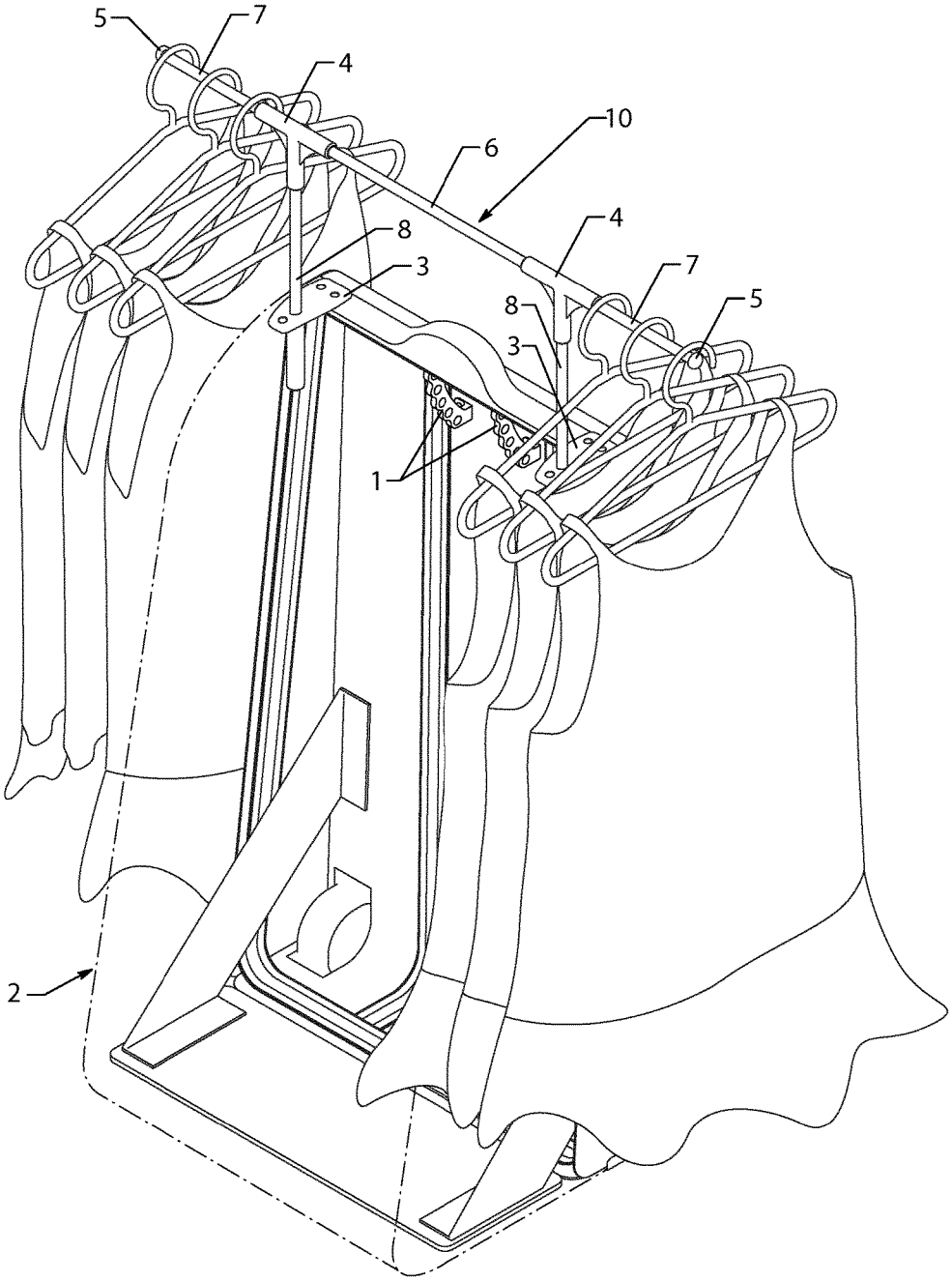
FIG. 12 is a perspective view showing the function of the exterior rack.

The present invention improves upon existing dance, sports, and garment bags by, for one, effectively fitting the garments within the interior. FIG. 2 shows a perspective view of an embodiment of the upright bag 2 of the present invention. In FIG. 2 you can see the rigid or semi-rigid upright bag, the interior mounted hangers 1 for hanging garments (or textiles, sports equipment, towels, accessories and the like), and the exterior mounted holders 3, which accept the collapsible exterior rack. FIGS. 3A-D shows preferred embodiments of the hangers 1 for hanging garments within the interior of the bag. These hangers 1 may be fabricated from plastic, metal, or synthetic materials, such as synthetic plastic material (e.g. polypropylene or polyurethane), and may be injection molded. This hanger 1 design allows the user to hang multiple garments within the bag. FIG. 4 shows an example of how the hangers 1 hold multiple garments within the bag. FIG. 5A shows the collapsible and removable exterior rack 10 in an expanded view. This exterior rack 10 consists of twelve total parts, including four end-caps 5, two T-connectors 4, two end tubes 7 that may be made of aluminum or similar material, one horizontal connecting tube 6 that may be made of aluminum or similar material, two vertical tubes 8 that may be made of aluminum or similar material, and two pieces of bungee cord 9 or similar material with elastic properties. The four end-caps 5 and two T-connectors 4 may be fabricated from plastic, metal, or synthetic materials, such as synthetic plastic material (e.g. polypropylene or polyurethane), and may be injection molded. In fact, the end tubes 7, horizontal connecting tube 6 and vertical tubes 8 may also be fabricated from plastic, metal, or synthetic materials, such as synthetic plastic material (e.g. polypropylene or polyurethane), and may be injection molded, as long as they are sufficiently strong. The horizontal connecting tube 6 may be permanently affixed to both T connectors 4. The bungee cord connects to the end caps, feeds through the horizontal end tube 7 and the T connector 4 then down through the vertical aluminum tube 8 and finishes in the lower end cap 5 (on both left and right sides) [see FIG. 5B]. FIG. 5C shows the exterior rack in its collapsed position. This exterior rack needs to collapse so it can be effectively stored (for instance, in the interior of the bag) when not in use. FIG. 6 shows the set-up exterior rack 10 before it is inserted into the exterior holders 3. These exterior holders 3 may be fabricated from plastic, metal, or synthetic materials, such as synthetic plastic material (e.g. polypropylene or polyurethane), and may be injection molded. FIG. 7 shows the exterior rack 10 fully inserted into the exterior mounted holders 3. The exterior mounted holders 3 have a tube portion that goes through the exterior fabric of the bag 2 and into the interior. This tube gives the proper depth to effectively hold the exterior rack 10. FIG. 8 is a front elevation view of the garment bag with the exterior rack 10 inserted. FIG. 9 is a top view of the garment bag with the exterior rack 10 inserted into the exterior mounted holders 3. FIG. 10 is a right side elevation view of the garment bag with the exterior rack 10 inserted into the exterior mounted holders 3. FIG. 11 is a left side elevation view of the garment bag with the exterior rack 10 inserted into the exterior mounted holders 3. FIG. 12 is a perspective view of the garment bag with the exterior rack inserted 10 showing the garments hanging from the left and right horizontal end tubes 7.

What is claimed is:

1. A rigid or semi-rigid upright garment bag comprising:

(a) an internal hanging system comprising means for hanging garments from a top interior portion of the bag;

(b) a collapsible and removable external hanging system comprising:

(i) first and second T-connectors each connectable at an inner distal end thereof by a horizontal connecting tube;

(ii) first and second horizontal end tubes each connectable at an inner distal end thereof to an outer distal end of the first and second T-connectors respectively;

(iii) first and second vertical tubes each connectable at an upper distal end thereof to a lower distal end of the first and second T-connectors respectively, said first and second vertical tubes each attachable at a lower distal end thereof to the holders mounted on the top exterior of the bag;

(iv) first and second lengths of bungee cord;

wherein said first length of bungee cord is attached at one end to an end cap that is attachable to an outer distal end of the first horizontal end tube, and wherein said first length of bungee cord runs through the first horizontal end tube from said end cap to the inner distal end of the first horizontal end tube then through the first T-connector from the outer distal end thereof to the lower distal end thereof then through the first vertical tube from the upper distal end thereof to the lower distal end thereof, and wherein said first length of bungee cord is attached at its other end to an end cap that is attachable to the lower distal end of the first vertical tube, and wherein said second length of bungee cord is attached at one end to an end cap that is attachable to an outer distal end of the second horizontal end tube, and wherein said second length of bungee cord runs through the second horizontal end tube from said end cap to the inner distal end of the second horizontal end tube then through the second T-connector from the outer distal end thereof to the lower distal end thereof then through the second vertical tube from the upper distal end thereof to the lower distal end thereof, and wherein said second length of bungee cord is attached at its other end to an end cap that is attachable to the lower distal end of the second vertical tube;

(c) holders mounted on the top exterior of the bag for receiving the collapsible and removable external hanging system; and (d) wheels located on the bottom of the bag for ease of transportation.

2. A device comprising:

(a) a garment bag having an exterior surface and defining an internal compartment;

(b) an internal hangar permanently disposed in the internal compartment;

(c) a holder having a first portion disposed in the internal compartment and a second portion abutting the exterior surface; and (d) an external hangar, wherein the external hangar is configured to be removably secured to the holder;

(e) a channel defined by the external hangar; and (f) a bungee cord disposed in a channel.

3. The device of claim 2, wherein the external hangar is movable between a first shape and a second shape.

4. A method comprising:

(a) stretching a bungee cord disposed in a channel defined by an external hanger to manipulate the external hanger from a first shape into a second shape, wherein the second shape of the external hangar includes a first portion and a second portion;

(b) securing the first portion to a bag, wherein the first portion is removably secured to the bag;

(c) opening the bag to expose a garment hanging on an internal hangar in an internal compartment defined by the bag, wherein the internal hangar is permanently secured to the bag; and (d) moving the garment from the internal hangar to the external hanger.

5. The method of claim 4, further comprising securing a holder to the bag, wherein the first portion is removably secured to the holder.

6. The method of claim 5, further comprising disposing a first portion of the holder in the internal compartment.

7. The method of claim 6, further comprising abutting a second portion of the holder with an exterior surface of the bag.

8. The method of claim 4, further comprising hanging the garment on the second portion of the external hanger.

9. The method of claim 8, wherein the second shape includes the first portion oriented orthogonally to the second portion.

* * * * *